United States Patent [19]

Yajima et al.

[11] 3,933,318

[45] Jan. 20, 1976

[54] TENSION CONTROL APPARATUS

[75] Inventors: Toshio Yajima, Toyonaka; Terukazu Ohta, Ikeda; Nobuhide Iwasaki, Itami, all of Japan

[73] Assignee: Kamitsu Seisakusho Ltd., Japan

[22] Filed: Apr. 8, 1974

[21] Appl. No.: 459,166

[30] Foreign Application Priority Data

Apr. 14, 1973 Japan ..... 48-41843

[52] U.S. Cl. ..... 242/154

[51] Int. Cl.[2] ..... B65H 59/30

[58] Field of Search..... 242/154, 153, 147 R, 150, 242/156, 156.2, 75.2, 75.3

[56] References Cited

UNITED STATES PATENTS

| | | | |
|---|---|---|---|
| 828,203 | 8/1906 | Foster | 242/154 |
| 1,014,980 | 1/1912 | Sykes | 242/154 |
| 1,022,512 | 4/1912 | Sipp | 242/154 |
| 2,419,808 | 4/1947 | Wirth | 242/156.2 |
| 2,964,259 | 12/1960 | Peel | 242/154 |
| 3,080,132 | 3/1963 | Fisher et al. | 242/154 |
| 3,087,689 | 4/1963 | Heim | 242/154 |

*Primary Examiner*—Stanley N. Gilreath
*Attorney, Agent, or Firm*—Robert E. Burns; Emmanuel J. Lobato; Bruce L. Adams

[57] ABSTRACT

A yarn tension control device for controlling the tension of yarn being longitudinally advanced having two movable yarn guide members with spaced guide pins alternately engaged by the longitudinally travelling yarn. One of the yarn guide members is pivotally mounted to move its guide pins across the yarn path and has a pin or roller mounted spaced from its pivot and is balanced by a balancing weight. A pivotally mounted control cam has a balancing weight and a laterally extending arm with a biasing weight adjustably positioned on the arm. The control cam has a cam profile in contact with the pin or roller on the first yarn guide member and the biasing weight biases this profile into engagement with the roller or pin to pivot the first yarn guide member in a desired direction. The portion of the arcuate cam profile nearest its pivot is concave, a middle portion thereof is nearly straight, and the portion of the cam profile furthest from the control cam pivot is convex. Thus as the first yarn guide member moves away from the second yarn guide member the biasing is decreased.

4 Claims, 6 Drawing Figures

TENSION CONTROL APPARATUS

BACKGROUND OF THE INVENTION

This invention relates generally to tension control apparatus for effecting a uniform constant tension in yarn being advanced to winding devices or the like. More particularly, this invention relates to an improved self-operable tensioning device of the type adapted to maintain a constant uniform delivery tension or winding tension.

In many textile operations, it is important that yarn be delivered to machines at a constant tension to prevent production of irregular and substandard products. Various types of tensioning devices or tensioners have been suggested. Two of the more common constructions include the gate-type tensioner, in which yarn passes between intermeshing posts or fingers, and the disc-type tensioner, in which yarn passes between a pair of discs, one of which is usually spring biased.

The tensioning devices presently in use possess disadvantages. Many devices are not designed to provide a uniform constant tension while others do not meet the necessary degree of accuracy, sensitivity and responsiveness demanded. Some designs are complicated in structure and expensive to manufacture, while oscillation and vibration difficulties are encountered with the employment of other constructions.

SUMMARY OF THE INVENTION

It is an object of this invention to provide constant tension control apparatus possessing features of simplicity, compactness, responsiveness, and economy. Another object is to provide an improved tensioner to delicately sense variations in stress in a running yarn and to act responsively to such variations so as to augment or to reduce drag on the yarn for establishing a predetermined uniform tension therein, especially in response with variations of unwinding tension of the supply yarn source. Another object is to provide a compensating tensioner that adjusts the amount of additional tension according to changes in tension in yarn forwarded to the tensioner so as to maintain a constant delivery tension therein. A further object is to prevent occurrence of yarn breakages due to the excessive delivery tension in yarn when the unwinding tension becomes considerably high. A still further object is to increase the winding speed, the efficiency of machine and also to produce good sound packages owing to a low constant delivery tension.

BRIEF DESCRIPTION OF THE DRAWINGS

The invention will be more readily understood from the following description of preferred embodiments thereof given by way of example with reference to the accompanying drawings, in which.

DESCRIPTION OF THE PREFERRED EMBODIMENTS

Figure 3:
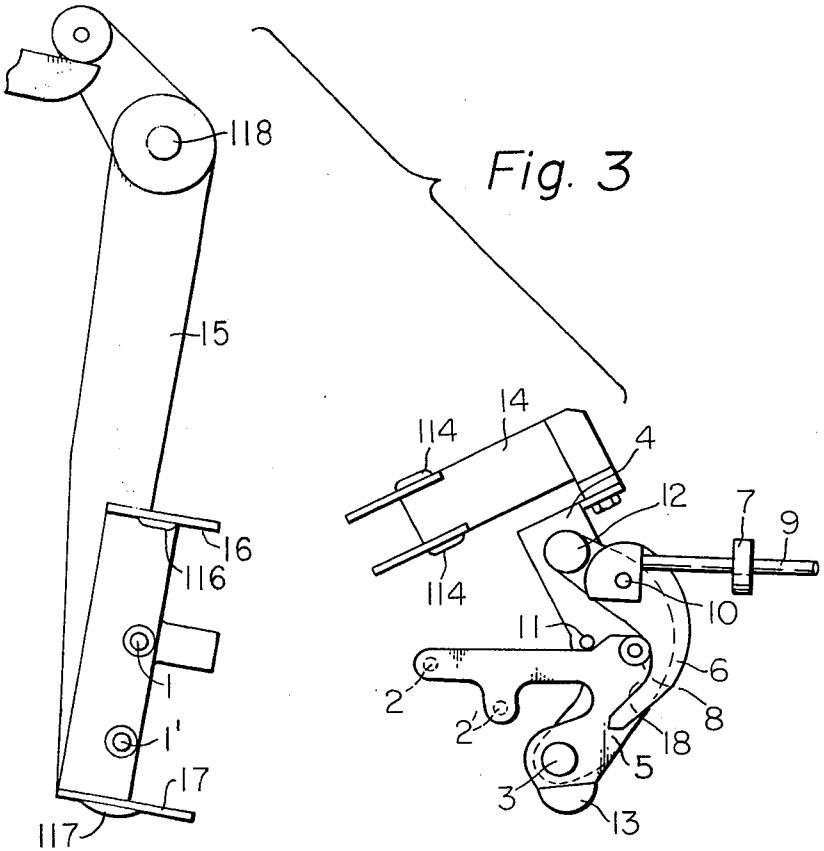
FIG. 3 is a view similar to FIG. 1, but shows the condition of a device prior to a yarn being threaded therethrough.
Figure 6:
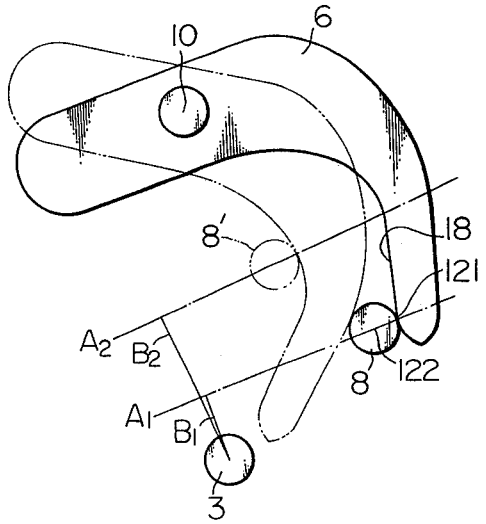
FIG. 6 is a detailed view of a cam profile of the present invention.

In FIG. 3, a support member 15, pivoted on a pivot pin 118 which is fixed on a machine frame by proper means has a pair of stationary guide pins 1, 1' and also two yarn guide plates 16, 17 having eyelets with slot 116, 117 respectively. A bracket 4, fixed on a machine frame by suitable means, is provided with a slub catcher 14, pivot pins 3, 10 and stopper 11 for limiting the movement of a rockable member 5. The rockable member 5 is rockably fulcrumed about the pivot pin 3 and is provided with a pair of movable guide pins 2, 2', a roller or pin 8 and a balancing weight 13. The center of gravity of the rockable member 5 which includes the guide pins 2, 2', the roller 8 and the balancing weight 13 is situated at the center of the pivot pin 3. This means that the turning of the rockable member 5 around the pivot pin 3 does not take place unless any external force acts upon the rockable member 5. The control cam 6 is rockably fulcrumed about pivot pin 10 and is provided with a balancing weight 12, a laterally extending arm 9, and a sliding weight 7 slidably mounted thereon in any desired position. The center of gravity of the control cam 6 which includes the extending arm 9 and the balancing weight 12 is situated at the center of the pivot pin 10. Therefore, the sliding weight 7 acts to urge the control cam 6 to swing clockwise about pivot pin 10 as shown in FIG. 3. Rockable member 5 and control cam 6 are engaged at the roller 8 and cam profile 18. Control cam 6 tends to swing clockwise, while the rockable member 5 tends to move counterclockwise about pivot pin 3. As the rockable member 5 swings counterclockwise, the roller 8 approaches the pivot pin 10, as shown in the roller position 8' in FIG. 6. The shape of the cam profile 18 is nearly straight, but the farthest point of it from the pivot pin 10 is convex and the nearest point of it to the pivot pin 10 is concave looking from the center of pivot pin 3. When considering the distance between the center of pivot pin 3 and the line passing through the center of roller 8 and the contact point between the roller 8 and the cam profile 18 because a force on said line is induced by the weight 7 so that a clockwise moment of force, which turns the rockable member 5 clockwise, is generated about the pivot pin 10, such a distance becomes rapidly larger when the contact point 121 approaches the pivot pin 10 from its farthest point, as shown by lines B1 and B2, because between these two lines the shape of the cam profile 18 is almost straight. When the contact point 121 approaches the pivot pin 10, the distance does not increase so sharply, because at this point the shape of the cam profile is concave. However, the clockwise moment of force about the pivot pin 10 induced by the weight 7 through the mechanism, which consists of the control cam 6 and the roller 8 mounted on the rockable member 5 pivotably mounted on the pivot 3, is nearly constant, therefore, the longer the distance from the pivot pin 3 to said line the stronger is the counter clockwise moment of force about the pivot pin 3, the counter clockwise moment of force about the pivot pin 3 acting to turn the rockable member 5 increases rapidly when the contact point between the roller 8 and the cam profile 18 of almost straight configuration approaches the pivot pin 10 while said moment of force increases dully when the contact point between the roller 8 and the cam profile 18 of concave configuration approaches the pivot pin 10, and said moment of force becomes almost constant, when said contact points are closest to pin 10. In this case, the cam profile 18 is so designed that the distance increases rapidly at the straight surface of the cam profile 18, while such increasing of the distance is quite small at the concave surface thereof. As the rockable member 5 swings counterclockwise, the ratio, that is, the swing angle of rockable member 5 around pivot pin 3 divided by a certain amount of swing angle of the control cam 6 around the pivot pin 10 becomes smaller. Preferably, as the rockable member 5 swings counterclockwise, the extending arm 9 nearly becomes horizontal. As described above, when the yarn is not threaded, the rockable member 5 is swung extremely counterclockwise by the control cam 6 until it engages with a stopper 11, as shown in FIG. 3.

Prior to operation the yarn 20 is led from the source of yarn supply in the following manner.

The support member 15 is turned away from the device by proper means, as shown in FIG. 3. After a yarn 20 has been threaded into the eyelets with slot 116, 117, the support member 15 is returned to its normal operating position. By this operation a yarn 20 can be threaded into the slub catcher 14, and a zig-zag yarn path is formed by the stationary guide pins 1, 1', the eyelet with the slot 117 and the movable guide pins 2, 2'. In operation, a sliding weight 7 is adjusted and positioned at a preselected position along the length of the extending arm 9 so as to provide a predetermined delivery tension, so that the control cam 6 and the extending arm 9 are forced in a clockwise direction to apply a desired moment force on the rockable member 5.

Figure 1:
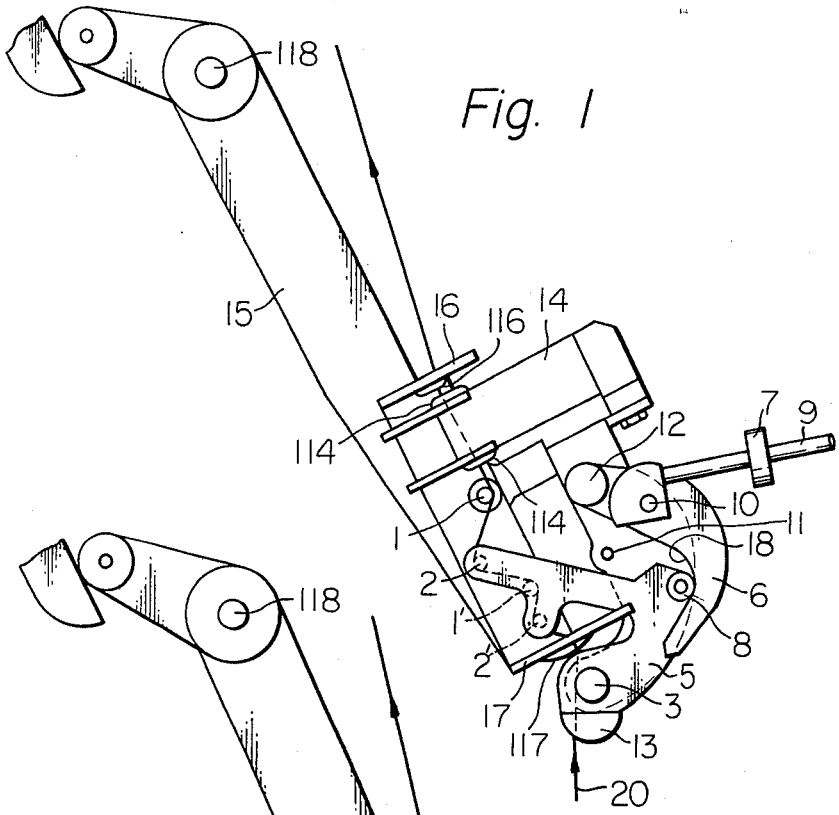
FIG. 1 is a side view of a tension device embodying the present invention shown interposed in the path of a yarn running from a yarn supply source (not shown) to a winding package (not shown)

When the yarn starts to run in FIG. 1, this yarn 20 is tensioned. And additional tension is added to the yarn by guide pins 2', 1', 2 and 1. By the unwinding tension of the supply yarn, and the additional tension caused by the yarn friction around the guide pins 2', 1', 2 and 1, the moment of force acts to swing the rockable member 5 in a clockwise direction about the pivot pin 3. The zig-zag yarn path is straightened against the counterclockwise moment of force of rockable member 5 which is caused by the clockwise moment of force of control cam 6, as described above. Consequently, the additional tension caused by the yarn friction around the guide pins 2', 1', 2 and 1 decreases and the rockable member 5 is stabilized at a new position being balanced with the counterclockwise moment caused by the control cam 6.

Figure 2:
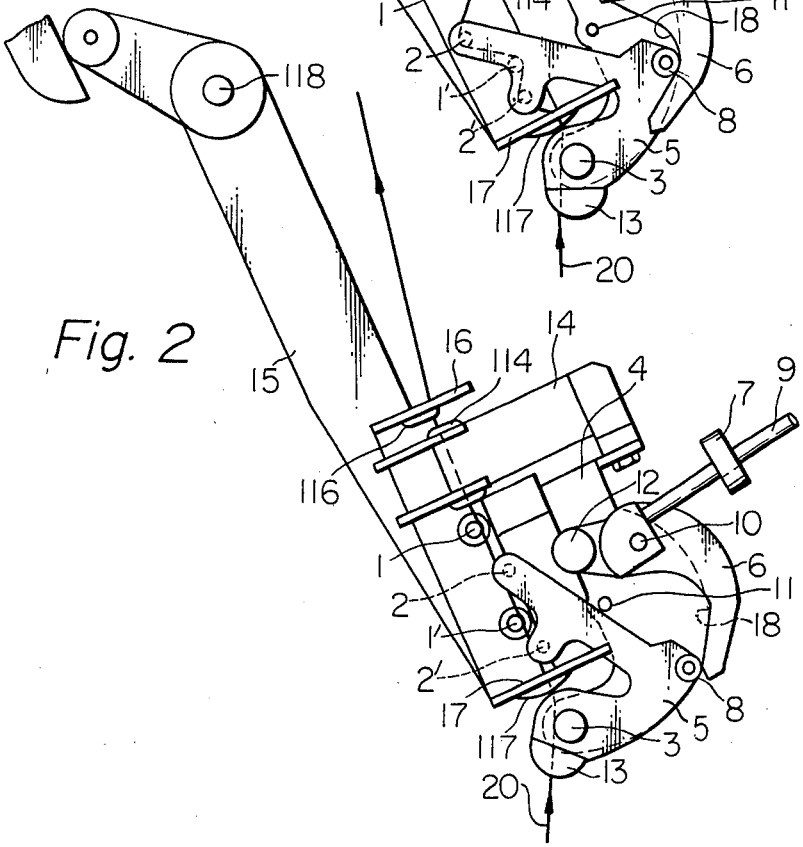
FIG. 2 is a view similar to FIG. 1, but shows a case where the unwinding tension is considerably high.
Figure 4:
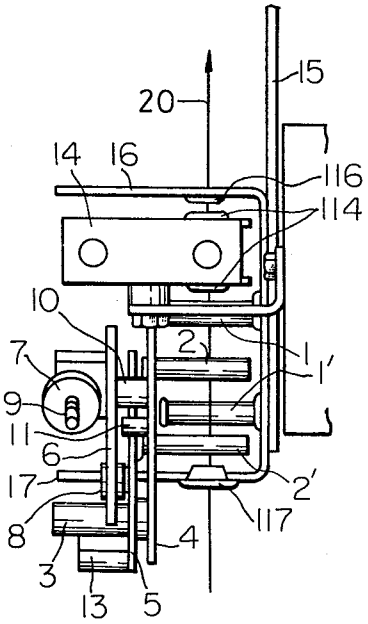
FIG. 4 is a front view of the device proper shown in FIG. 1.

As shown in FIG. 2, the supply yarn, when being unwound and a condition is almost reached where the bobbin is almost bare, the unwinding tension becomes considerably high, the clockwise moment of the rockable member 5, due to the reaction of the yarn 20, increases so that the rockable member 5 is turned clockwise. Therefore, the control cam 6 is turned counterclockwise. However, as mentioned before, due to the shape of the cam profile 18, the component force of the clockwise moment, which forces the rockable member 5 to turn counterclockwise, of control cam 6 is reduced. As the rockable member 5 swings in a clockwise direction about pivot 3, the contact point 121 of roller 8 with cam profile 18 approaches the farthest point on cam profile 18. This means that the counterclockwise moment of force about pivot pin 3 caused by the engagement of roller 8 with cam profile 18 of control cam 6 with weight 7 decreases, as described above. In this case when the zig-zag yarn path becomes a straight yarn path, the contact angle of the yarn with the guide pins decreases, and additional tension by guide pins 2', 1', 2 and 1 also decreases. In spite of an increase of unwinding tension, the tension device of the present invention continually adjusts and compensates for an increase of unwinding tension so as to provide a constant uniform delivery of tension in the yarn.

Figure 5:
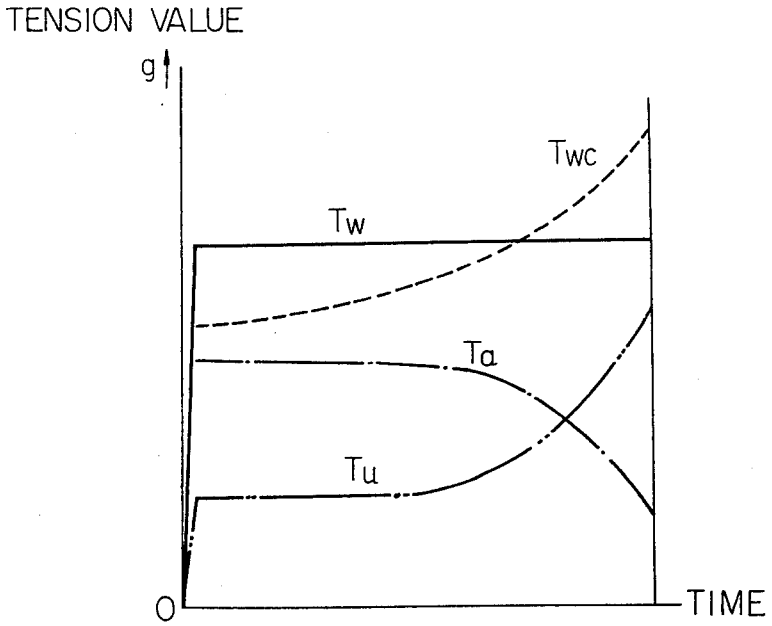
FIG. 5 is a schematic diagram which shows tension values from the time a supply cop is full to the time of an almost exhausted bobbin. Tu is the unwinding tension of supply cop. Tw is the delivery tension value using the device of the present invention. Ta is the additional tension value using the device of the present invention. Twc is the delivery tension value using the conventional tension device.

As schematically shown in FIG. 5, in a case where a conventional tension device is used the delivery tension Twc increases as the winding goes on, as shown by the dotted line. This is because the unwinding tension Tu increases as the winding goes on, as shown by the two dots and bar line. According to the tension device of the present invention, additional tension Ta varies in response with the unwinding tension Tu, as shown in a dot and bar line. As a result, the sum of the unwinding tension or incoming tension Tu in the yarn, plus the additional tension Ta always equals the constant predetermined uniform delivery tension Tw, as shown by the solid line.

The outstanding feature of the present invention is clearly shown by the following practical data. The angle $\theta$ is a contact angle between the running yarn and the stationary pins or the movable pins. The n is a number of pins. In this case, the coefficient of friction between the running yarn and the pins is 0.2 and the stationary pins are three and the movable pins are two. Other factors and dimensions are decided reasonably.

| Condition of supply package | Unwinding tension Tu in grams | Additional tension Ta in grams | Summed angle $n \times \theta$ in radians |
|---|---|---|---|
| Full cop | 9 | 21 | 6 |
| 90% stripped cop | 20 | 10 | 2 |
| Almost empty cop | 25 | 5 | 0.9 |

For example, when the unwinding tension Tu increases from 9 grams to 25 grams, the additional tension Ta correspondingly decreases from 21 grams to 5 grams and the summed angle $n \times \theta$ decreases from 6 radians to 0.9 radians. By using the yarn tension device of the present invention, the delivery tension Tw can be always maintained at 30 grams. The rockable member 5 turns a total of 11 degrees in a clockwise direction from the beginning to the end of an unwinding operation for one supply cop.

What is claimed is:

1. A yarn tension control device for controlling the tension of a running yarn comprising, first and second yarn guide members having yarn guide pins alternately engaged by traveling yarn, means mounting the first yarn guide member pivotally free to pivotably move rockably across the normal yarn path, means movably mounting the second yarn guide member, the first yarn guide member mounting a roller or pin spaced from the pivot thereof and a first balancing weight, a control cam pivotally mounted and having a second balancing weight and an extending arm, a third weight adjustably mounted on said extending arm, said control cam having a cam profile which contacts said roller or pin mounted on the first yarn guide member, and the third weight and said extending arm biasing said cam profile into engagement with said roller or pin to pivot the first yarn guide member in a desired direction.

2. A yarn tension control device as claimed in claim 1, wherein the nearest portion of said cam profile to the pivot of said control cam is concave, the middle portion of said cam profile is nearly straight, and the farthest portion of said came profile from said pivot of said control cam is convex, whereby as the first yarn guide member moves away from the second yarn guide member said biasing is decreased.

3. A yarn tension control device as claimed in claim 1, further comprising a stop for limiting the turning movement of the first yarn guide member.

4. A yarn tension control device as claimed in claim 1, wherein said means movably mounting the second yarn guide member comprises a movable support member.

* * * * *